United States Patent [19]

McManus

[11] Patent Number: 4,951,867

[45] Date of Patent: Aug. 28, 1990

[54] FOLDING SEPARATOR

[76] Inventor: Dick McManus, 120 Kapuahi St., Makawao, Hi. 96768

[21] Appl. No.: 445,391

[22] Filed: Dec. 4, 1989

[51] Int. Cl.[5] ..... B65D 5/48

[52] U.S. Cl. ..... 229/120.31; 229/120.33; 229/120.34; 229/120.37

[58] Field of Search ..... 229/120.31, 120.33, 229/120.34, 120.37

[56] References Cited

U.S. PATENT DOCUMENTS

| | | | |
|---|---|---|---|
| 973,429 | 10/1910 | Hilliker | 229/120.34 |
| 2,023,578 | 12/1935 | Daley | 229/120.33 |
| 2,925,947 | 2/1960 | Brown | 229/120.31 |
| 3,843,039 | 10/1974 | Brown et al. | 229/120.31 |
| 4,574,996 | 3/1986 | Brian | 229/120.33 |
| 4,579,276 | 4/1986 | Manizza | 229/120.33 |

*Primary Examiner*—Gary E. Elkins

*Attorney, Agent, or Firm*—I. Michael Bak-Boychuk

[57] ABSTRACT

A cardboard retaining structure defined by a peripheral strip joined at the ends to form a continuous loop and creased to form fold lines thereacross. The fold lines are spaced to define substantially equal front and rear panels in the strip separated by substantially equal lateral panels. The loop therefore may be collapsed into a folded planar structure one or more separator panels extend between the front and rear panels and the front panel is provided with a notched flap to engage the edge of the separator panel in an orthogonal alignment therewith.

3 Claims, 2 Drawing Sheets

FOLDING SEPARATOR

BACKGROUND OF THE INVENTION

1. Field of the Invention

The present invention relates to folding cardboard structures and, more particularly, to foldable cardboard structures unfolded in the trunk of a motor vehicle to confine stored articles therein.

2. Description of the Prior Art

The use of cardboard boxes in the trunk of a motor vehicle has been extensively practiced in the past. Typically, a cardboard box is placed in the trunk to confine various transported articles against excessive movement. Once so used the box is then discarded until the next occasion of necessity.

In consequence the operator of the vehicle is constantly on a search for more cardboard boxes with each subsequent transport. Quite often these searches are not productive and the operator must then resort to care and attention in the course of vehicle movement to avoid damage to the articles transported.

A convenient retaining structure which may be easily folded when not in use is extensively sought and it is one such structure that is disclosed herein.

SUMMARY OF THE INVENTION

Accordingly, it is the general purpose and object of the present invention to provide a collapsible containing structure which folds into a flat piece.

Other objects of the present invention are to provide a folding separator structure useful in the trunk of a motor vehicle.

Yet further objects of the invention are to provide a cardboard structure which when folded to one configuration provided containment openings for articles and in the other folded configuration collapses for storage.

Briefly, these and other objects are accomplished within the present invention by providing an elongate cardboard strip joined at its ends to form a cotinuous periphery and creased to fold as a parallelogram of varying interior angle. The location of the creases is selected to define two opposed longer peripheral segments of equal dimension and two opposed shorter segments. A divider of a plan form substantially equal to the plan form of the shorter segments extends between the longer segments to define a plurality of apertures therewith.

Thus, the foregoing combination of panels may be folded in the manner of a parallelogram, into a collapsed stack for storage. When deployed for article confining use a set of notched flaps may be advanced into arcuate cutouts at one corner of the divider panel until engagement is reached between the notch and the cutout. This engagement then fixes the segments in a rectangular alignment, forming rectangular apertures into which the transported articles are placed.

DESCRIPTION OF THE SPECIFIC EMBODIMENT

Figure 1:
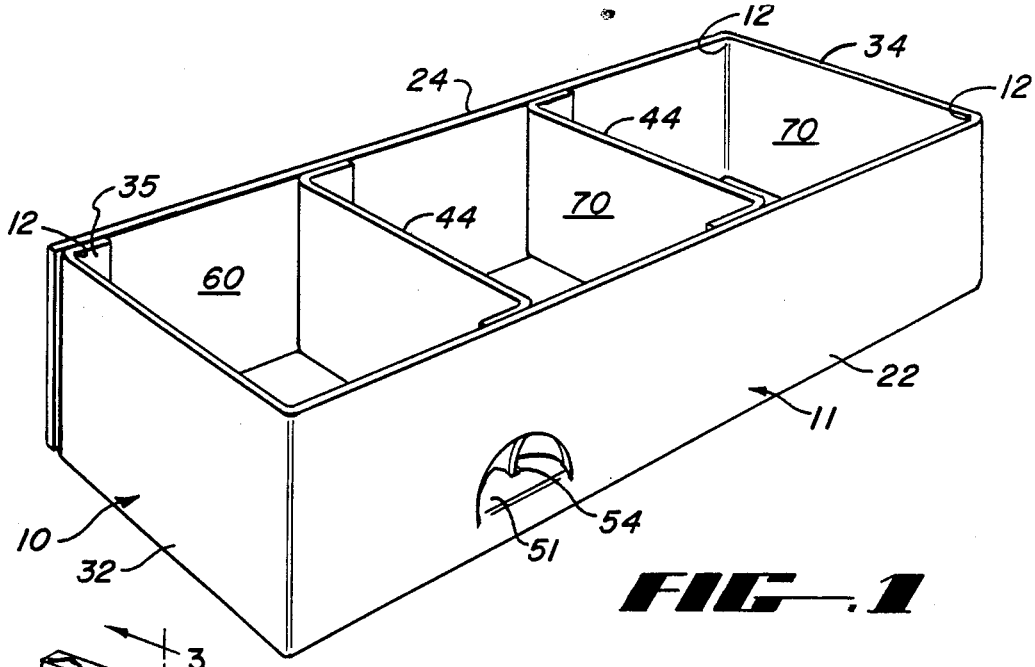
FIG. 1 is a perspective illustration of an article storing assembly unfolded for use.
Figure 2:
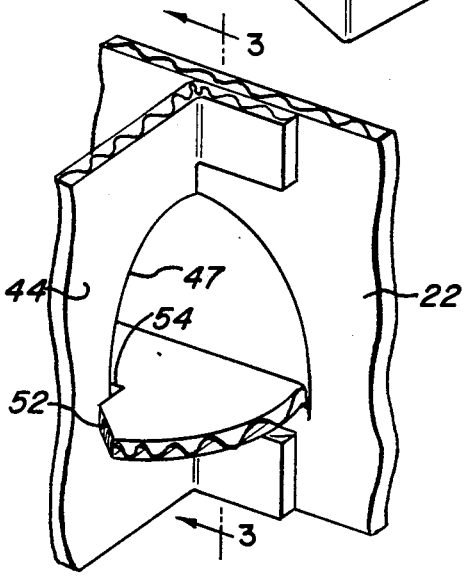
FIG. 2 is yet another perspective illustration of one detail generally shown in FIG. 1.
Figure 3:
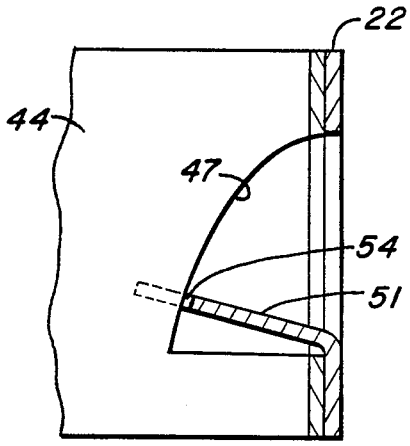
FIG. 3 is a sectional detail taken along the line 3—3 of FIG. 2.
Figure 4:
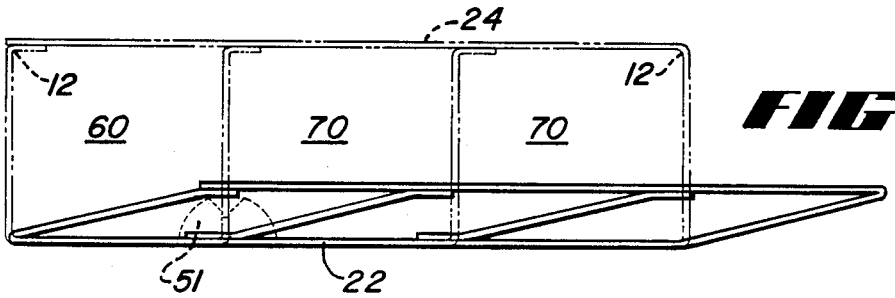
FIG. 4 is a top view illustrating the deployment of the inventive assembly.

As shown in FIGS. 1–4 the inventive storing assembly, generally designated by the numeral 10, includes an elongate cardboard strip 11 segmented by a plurality of transverse creases 12 into two opposed longitudinal segments 22 and 24 and two lateral segments 32 and 34. Preferrably, strip 11 includes segment 22 at one end with segment 34 being located at the other end. A gluing strip 35 is formed along the free transverse edge of segment 34 to be glued to and along the free transverse edge of segment 22. In this manner a loop is formed by adhesively connecting the ends of strip 11 to each other, the loop taking the general form of a parallelogram defined by the spacing between the adjacent creases 12.

In this form the parallelogram may be collapsed to various internal angles, including a fully collapsed alignment at which the various segments 22, 24, 32 and 34 are laid on top of each other. When thus collapsed, the assembly stores conveniently within the trunk of a car, stowing beneath any floor covering or on top of any structural panel.

To provide some dimensional stability when unfolded and to define a plurality to storage apertures divider panels 44 are glued between the opposing segments 22 and 24, each of the panels 44 including edge gluing strips 45 distal of folding creases 46. One vertical edge of panel 44 may be provided with an arcuate cutout 47 adjacent a notched flap 51 cut into the segment 2. This notched flap 51 is defined by a faired notch 52 providing a larger spacing B at the flap edge and fairing to a narrow gap 54 for engagement with the panel.

Preferrably flap 45 is cut in the segment surface proximate one or the other edge thereof and when pressed out of the segment plane will then engage the arcuate cutout edge in the panel 44. This then fixes the relative angle of the panel, fixing the opened geometry of the assembly. When thus fixed a plurality of cavities 60 and 70 is provided into which articles may be placed for transport.

In this manner the free motion of any article is limited to the size of the cavities, limiting the momentum acquired by the article due to vehicle motion.

Figure 5:
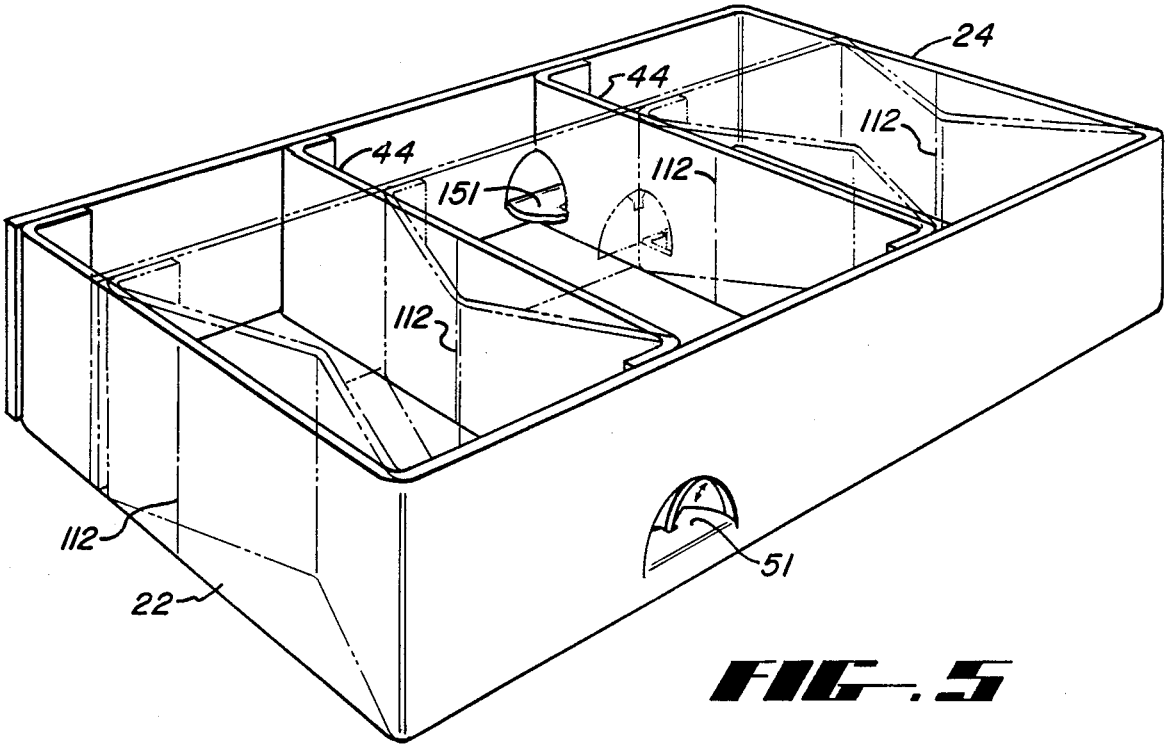
FIG. 5 is yet another perspective illustration of an alternative implementation of the inventive device.
Figure 6:
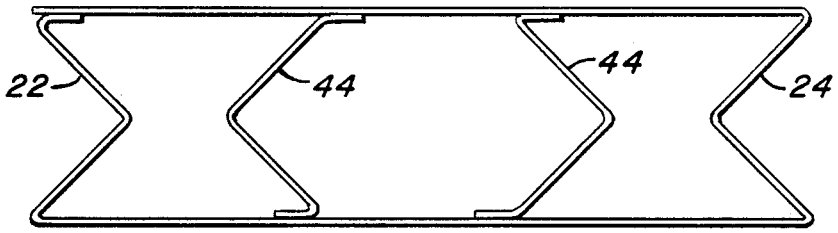
FIG. 6 is a top view of the device shown in FIG. 5 jin the course of its folding.

In the alternative, shown in FIGS. 5 and 6, each of the panels 44 and the end segments 22 and 24 may be scribed with central, vertical fold lines 112. In the manner previously described, like numbered parts having a like function, the panels and end segments may be folded to an accordion configuration reducing the collapsed length of the structure. Of course, a second flap 151 need then be provided to effect the function of flap 51 on the other side of fold lines 112.

Thus, a conveniently folded storage assembly is devised which when not needed, stores as a flat object along any vehicle panel.

Obviously, many modifications and changes may be made to the foregoing description without departing from the spirit of the invention. It is therefoe intended that the scope of the invention be determined solely on the claims appended thereto.

What is claimed is:

1. A collapsible containment structure comprising:

a substantially rectangular pripheral strip of elongate form having the ends thereof joined to each other to form a continuous loop and including a plurality of crease lines formed thereacross for defining folds therein, said crease lines being spaced to provide a front and a rear panel each of substantially equal rectangular plan form and a first and second lateral panel interspaced therebetween;

a separator panel extending between said front and rear panels, said separator panel including an arcuate edge cutout proximate said front panel; and an arcuate flap formed in said front panel adjacent said edge cutout and including a notch at the apex thereof for engaging said edge cutout, whereby said notch upon the engagement of said cutout aligns said separator panel substantially orthogonal to said front panel.

2. Apparatus according to claim 1 wherein:

said peripheral strip and said separator panel are each formed of a cardboard material structure.

3. Apparatus according to claim 2 wherein:

said notch is generally formed to include a tapered opening therein.

* * * * *